United States Patent [19]

Krause

[11] 4,346,939

[45] Aug. 31, 1982

[54] COWL ASSEMBLY FOR LONGWALL MINING MACHINE

[75] Inventor: Rolf Krause, Essen, Fed. Rep. of Germany

[73] Assignee: Gerb. Eickhoff Machinenfabrik und Eisengiesserei m.b.H., Bochum, Fed. Rep. of Germany

[21] Appl. No.: 195,245

[22] Filed: Oct. 7, 1980

[30] Foreign Application Priority Data

Oct. 17, 1979 [DE] Fed. Rep. of Germany ..... 2941921

[51] Int. Cl.[3] ..... E21C 35/20

[52] U.S. Cl. ..... 299/45; 299/67

[58] Field of Search ..... 299/45, 67

[56] References Cited

U.S. PATENT DOCUMENTS 3,482,879 12/1969 Droste et al. ..... 299/45

4,068,894 1/1978 Dring ..... 299/45

FOREIGN PATENT DOCUMENTS 2246288 3/1974 Fed. Rep. of Germany ..... 299/45

*Primary Examiner*—Ernest R. Purser

*Attorney, Agent, or Firm*—Thomas H. Murray

[57] ABSTRACT

A cowl assembly for the cutter drum of a longwall mining machine, the cowl being arranged for pivoting or slewing movement about the cutter drum axis and having at least one driving motor to pivot it, the driving motor output gear meshing with a toothed annulus on an elongated cylindrical support member disposed centrally of the cutter drum axis.

7 Claims, 6 Drawing Figures

COWL ASSEMBLY FOR LONGWALL MINING MACHINE

BACKGROUND OF THE INVENTION

The present invention relates to a longwall mining machine of the type having a pivot arm which supports a cutter drum for rotation about an axis for working a mine face. A cowl or clearing shield is positioned at a desired location about the periphery of the cutter drum. In a mining machine of this type, the rotating cutter drum cuts the material being mined and is provided with spirals which assist in loading the mine material onto a face conveyor. The loading efficiency is improved with the use of the cowl comprising an arcuate plow which follows behind the cutter drum and which can be pivoted from one side of the drum to the other, depending upon the direction of movement of the mining machine.

In West German Offenlegungsschrift No. 26 48 881, there is disclosed a system for pivoting a cowl of this type in which the cowl is mounted for pivotal movement about the rotational axis of the cutter drum. A hydraulic motor, used to effect pivotal movement, engages a gear element situated centrally with respect to the rotational axis of the cutter drum and is disposed within the plane of the pivoting gear element. A holder for the cowl is connected to the pivoting gear element which rides on a relatively narrow annulus. Since the cowl extends over the entire length of the cutter drum but is borne only at one side of the drum by the narrow annulus, both the pivoting gear and the annulus carrying the same experience severe stresses because of their narrowness. These stresses, caused by the weight of the cowl, and also because of its single-ended overhung or cantilever mounting, result in bending moments, particularly in the case of large diameter cutter drums.

Another arrangement for pivoting a cowl of the type described above is shown in copending application Ser. No. 44,790, filed May 31, 1979, now U.S. Pat. No. 4,251,112. In this case, as in the German publication described above, the ring on which the cowl is carried rotates on a relatively narrow annulus which is subject to substantial stress.

SUMMARY OF THE INVENTION

In accordance with the present invention, a new and improved mounting assembly for a cutter drum cowl is provided wherein the mounting can receive substantial bending moments without producing severe stress, particularly in the case of large diameter cutter drums.

Specifically, the mounting assembly of the invention is pivotal about the axis of the cutter drum and comprises a cylindrical member positioned within the hollow cutter drum and extending along a substantial length of the cutter drum. Bearing means are provided at the opposite ends of the cylindrical member for mounting it on a support element for the cutter drum. An arm extends radially outwardly from the cylindrical member at the inner end thereof, this arm acting to support the cowl itself. In a typical case, the cylindrical member positioned within the hollow cutter drum is substantially half the length of the cutter drum. For this reason, and since the cylindrical member is supported on bearings at its opposite ends within the cutter drum, the moments which can be tolerated are considerably greater than in the case of prior art cowl mountings wherein the entire support is provided on a relatively narrow annulus.

In accordance with another aspect of the invention, the driving motor means for pivoting or slewing the cowl is disposed inside the cutter drum itself and has an output gear which meshes with an internally-toothed annulus of the cylindrical drum which carries the cowl. The drive motor means is preferably disposed at the outboard end of the cutter drum assembly and is mounted on a hub which carries the cutter drum itself. In this way, the driving motor means requires no additional space within the cutter drum and is also protected inside the cutter drum, the motor means preferably being positioned between reduction gearing for the cutter drum driving motor and the cutter drum flange which carries the cutter drum itself. Typically, a number of driving motors are distributed around the periphery of the cylindrical drum, which carries the cowl, and are mounted on a common ring extending around the cylindrical member which carries the cutter drum. This enables the driving torque to be applied to the cowl around the entire periphery of the cylindrical drum on which it is carried. This is feasible because of the use of motors which are relatively small and, therefore, particularly suitable for this purpose.

Advantageously, the cylindrical drum which carries the cowl is rotatably mounted on a bearing only near the arm which carries the cowl. At its opposite end, it bears by way of its internally-toothed annulus on the output gears of the aforesaid driving motors. This feature, in addition to providing a statistically determined support for the cylindrical drum, eliminates the need for a special mounting at the end of the drum adjacent the motors. At the end of the cylindrical drum adjacent the toothed annulus is an internal annular, resilient strip which bears on an annular support member for the drum. In this manner, the radial stresses emanating from the cutter drum and transmitted to the cylindrical drum which supports the cowl are not fully absorbed by the drive motor output gears.

The cylindrical support drum can be flanged to the arm which carries the cowl with axial clearance. With this type of connection, the complete driving torque of the motors is transmitted to the cowl support arm, but the connection compensates for unavoidable tolerances in the production of the toothed annulus which may impair the engagement of the driving motor output gears with the annulus. As a protection against explosive atmospheres, and also to insure very uniform load distribution between the various drive motor output gears, the drive motors are preferably hydraulic and are connected in parallel to one another between two ring supply lines which extend around the support element carrying the cutter drum.

The above and other objects and features of the invention will become apparent from the following detailed description taken in connection with the accompanying drawings which form a part of this specification, and in which.

Figure 1:
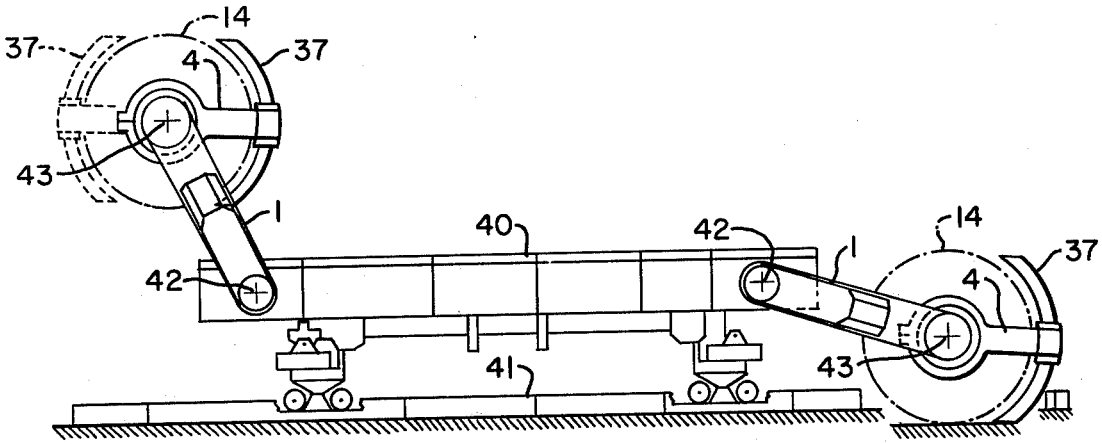
FIG. 1 is a side elevational view, partly in section, of a cutter drum mounted on a drum support arm of a longwall mining machine.

With reference now to the drawings, and particularly to FIG. 1, there is illustrated a longwall drum-cutter mining machine 40 which is supported for movement on a face conveyor 41 in a manner well known in the art. The mining machine 40 includes a cutter drum 14 at each end of the machine mounted on a support arm 1 adapted to pivot about axis 42 from the lower position shown at the right of the machine to an elevated position shown on the left of the machine. As will be seen, the cutter drums 14 remove coal or other mineral material from the mine face and are provided with spirals which convey the mined material backwardly onto the conveyor 41 where it is transported away from the face area. Pivotal about the axis of rotation 43 of each cutter drum 14 is a cowl support arm 4 which carries at its outer extremity the cowl 37 itself. The cowl is pivotal from the full-line position shown in FIG. 1, for example, to the broken-line position illustrated on the left-hand drum 14. It serves to direct coal being mined onto the face conveyor and, at the same time, is usually provided with water sprays which reduce the possibility of excessive coal dust escaping into the atmosphere.

Figure 2:
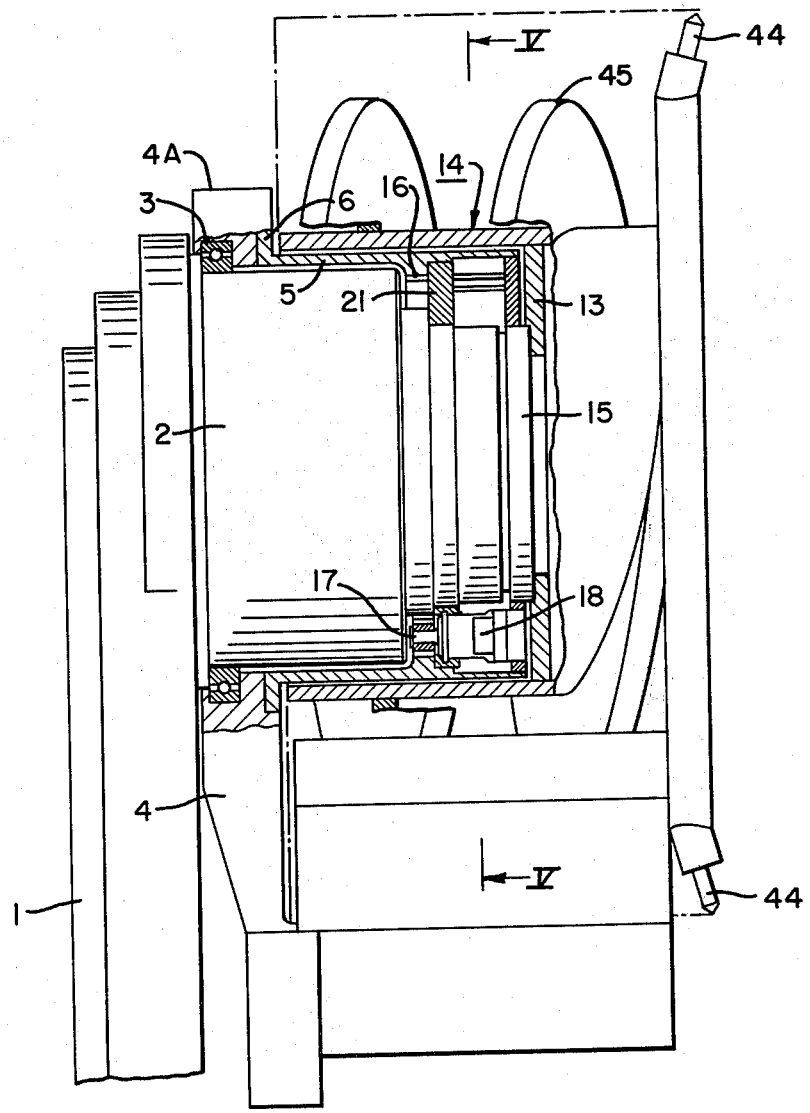
FIG. 2 is a side view of a cutter drum, partly in section, showing the cowl assembly of the invention.

The details of the cutter drum and cowl assembly are shown in FIG. 2. The drum itself is again identified by the reference numeral 14 and is provided with forward cutting picks 44 and a surrounding spiral 45 which conveys the mined coal backwardly and onto the aforesaid face conveyor (not shown in FIG. 2) as the drum 14 rotates. Extending outwardly from the support arm 1 is a hub 2 which supports the cutter drum 14 for rotation and which houses reduction gearing in the form of planetary gearing. At the end of hub 2 is an annular plate 13 driven by the aforesaid reduction gearing and welded at its outer periphery to the cutter drum 14 such that as the plate 13 rotates, so also will the cutter drum 14.

Figure 6:
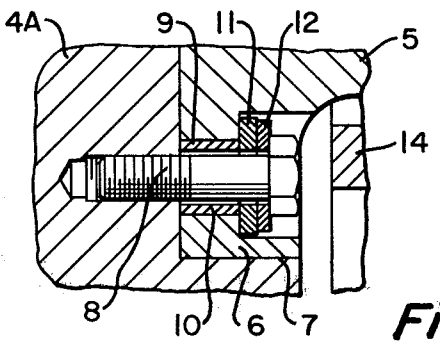
FIG. 6 is an enlarged cross-sectional view showing the manner in which the inboard end of the support drum for the cowl is secured to a ring member which carries the cowl.

Extending around the housing 2 is a bearing 3 whose inner race is mounted on the hub 2 and whose outer race supports a ring 4A connected to the cowl support arm 4. For ease of assembly, the ring 4A is formed in two parts which are bolted together. The ring 4A is carried by a cylindrical cowl support drum 5 provided with a flange 6 which, as shown in FIG. 6, is disposed within a corresponding groove 7 in the cowl support arm ring 4A. Bolts 8 distributed over the periphery of flange 6 act to secure the cylindrical support drum 5 to the cowl support arm ring 4A while facilitating limited axial movement of the drum 5. In this regard, each bolt 8 extends through a bushing 10 disposed in a bore 9 formed in flange 6 and has a shank portion which is slightly longer than the thickness of the flange. Interposed between the head of the bolt 8 and the cowl support arm 4 are a washer 11 and a cup spring 12 which, as will be appreciated, permit limited axial movement of the element 4 with respect to the support drum 5.

Figure 3:
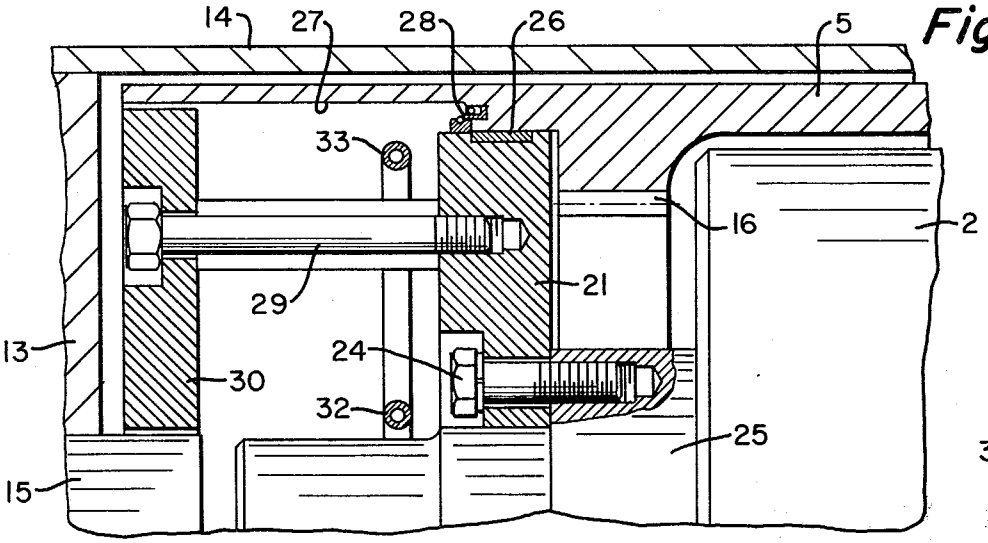
FIG. 3 is an enlarged view of one end of the cylindrical drum which carries the cowl, showing the manner in which the toothed annulus is supported on a circular support plate.
Figure 4:
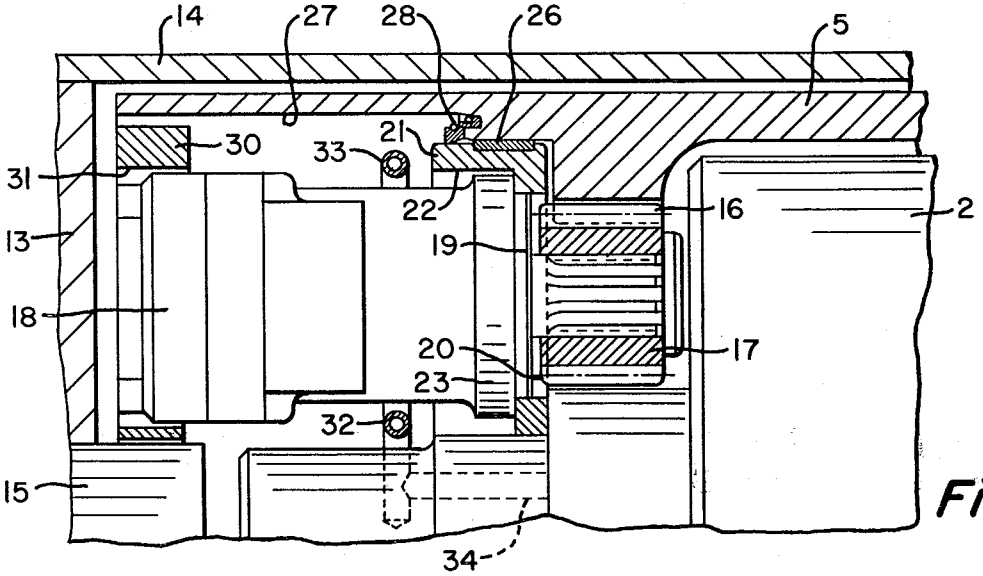
FIG. 4 is an enlarged view of one of the drive motors used to drive the toothed annulus on the cowl support drum.

The cowl support drum 5 extends around the hub 2 over a portion of its length only and extends outwardly from the bearing 3 to the support plate 13 for the drum 14, the support plate 13 being adjacent a flange 15 on the hub 2. As can be seen from FIG. 2, there is a reduction in the diameter of the hub 2 immediately preceding the flange 15. An internally-toothed annulus 16 (see also FIGS. 3 and 4) on the cowl support arm 5 is disposed in the space between the support plate 13 and the large diameter portion of hub 2. The annulus 16 meshes with the teeth of output driving gears 17 of a number of driving motors 18 spaced about the periphery of the toothed annulus 16. Each motor 18 is carried on a stationary ring 21 mounted on the hub 2, the ring 21 being provided with circumferentially-spaced bores 20 (FIG. 4) which receive collars 19 on the motors 18. Flanges 23 on the motors 18 are fitted within openings 22 in the ring 21 and serve to secure the motors to the ring. The ring 21, in turn, is fitted over the reduced diameter portion of hub 2 and is retained in position by axially-extending bolts 24 which are threaded into a shoulder 25 (FIGS. 3 and 5) formed on the hub 2.

A resilient strip 26 (FIGS. 3 and 4) extends around the ring 21 and closes the gap between a bore 27 in the drum 5 and the outer periphery of the ring. The resilient strip 26 is preferably formed from material such as Teflon (Trademark). The radial clearance corresponding to the tooth gap between the driving gears 17 and the toothed annulus 16 is left between the outer periphery of the strip 26 and the inner periphery of the drum 5. A seal 28 is disposed in a groove in drum bore 27 and abuts the outer periphery of the ring 21 to provide a dust-tight closure which prevents dirt from entering the gap between the outer periphery of strip 26 and the inner periphery of the drum 5. Axial threaded pins 29 (FIG. 3) connect the ring 21 to a stationary annular plate 30. Disc 30 is formed with recesses 31 (FIG. 4) which receive the trailing ends of motors 18. The main function of the disc 30 is to prevent debris from entering the interior of the support drum 5.

Figure 5:
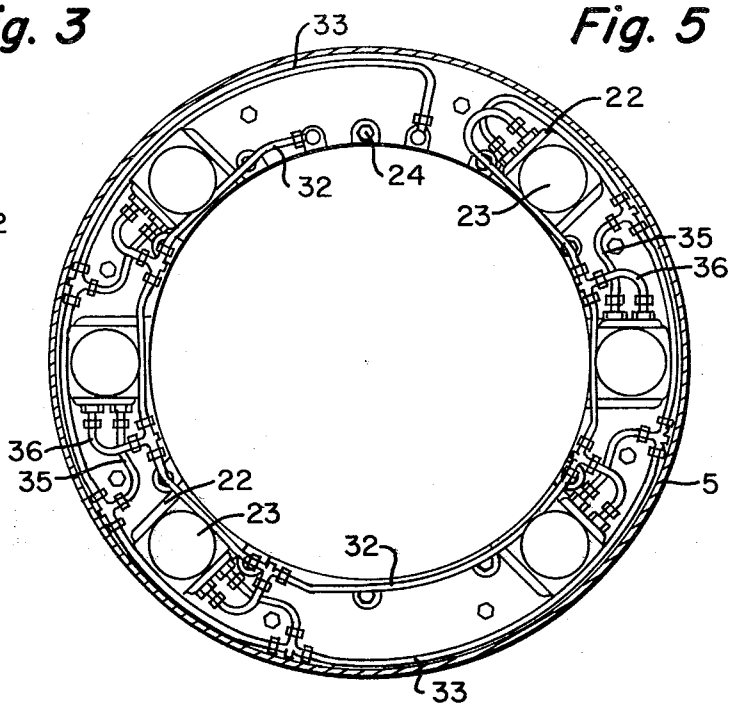
FIG. 5 is a cross-sectional view taken substantially along line V—V of FIG. 1 showing the spacing of the hydraulic drive motors utilized in the invention.

Hydraulic driving motors 18 are connected to two hydraulic supply lines 32 and 33 which extend around the periphery of ring 21 as shown in FIG. 5. Both of the hydraulic supply lines 32 and 33 communicate via bores 34 (FIG. 4) in the hub 2 with hydraulic supply lines, not shown, in the cutter drum support arm 1 and are supplied with hydraulic fluid by a hydraulic unit carried on the longwall mining machine. All of the driving motors 18 are connected via conduits 35 to the outer supply ring 33 and via conduits 36 with the inner supply ring 32. Consequently, the load is shared between the various driving motors when one of the two supply lines 32 or 33 is pressurized. The rotation effected by the drive motors is transferred through the support drum 5 to the arm 4 and hence acts to pivot the cowl from, for example, the solid-line position shown in FIG. 1 to the broken-line position shown.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A cowl assembly for the hollow cutter drum of a longwall mining machine mounted for rotation on a support element extending outwardly from a cutter drum support arm, said cowl assembly being pivotal about the axis of the cutter drum and comprising a cylindrical member positioned within the hollow cutter drum and extending along a substantial length of the cutter drum, bearing means for mounting the opposite ends of said cylindrical member on said support element, an arm extending radially outwardly from said cylindrical member, and a cowl carried on said arm.

2. The cowl assembly of claim 1 wherein the cutter drum is mounted for rotation on the outboard end of said support element and said cylindrical member extends from the inboard end of the support element substantially to the point within the cutter drum at which the cutter drum is mounted on the support element.

3. The cowl assembly of claim 1 wherein said radially-extending arm is secured to said cylindrical member with fastening elements which permit limited axial movement between the two.

4. A cowl assembly for the hollow cutter drum of a longwall mining machine mounted for rotation on a support element extending outwardly from a cutter drum support arm, said cowl assembly being pivotal about the axis of the cutter drum and comprising a cylindrical member positioned within the hollow cutter drum and extending along a substantial length of the cutter drum, an internally-toothed annulus on said cylindrical member positioned within the hollow cutter drum, a plurality of gears connected to drive motors circumferentially spaced around said toothed annulus for rotating the same, bearing means for mounting the opposite ends of said cylindrical member on said support element, an arm extending radially outward from said cylindrical member, and a cowl carried on said arm.

5. The cowl assembly of claim 4 characterized in that the cylindrical member is rotatably mounted on said support element only at its inboard end and at its opposite end is supported on said drive motor gears.

6. The cowl assembly of claim 4 wherein said drive motors are hydraulic motors and including two hydraulic supply lines extending around said annulus for supplying hydraulic fluid under pressure to the drive motors in parallel.

7. The cowl assembly of claim 4 wherein said drive motors are carried on a stationary annular ring, and a resilient strip interposed between the outer periphery of said ring and the inner periphery of said cylindrical member.

* * * * *